US006566025B1

(12) United States Patent
McStravick et al.

(10) Patent No.: US 6,566,025 B1
(45) Date of Patent: May 20, 2003

(54) POLYMERIC PARTICLES AS EXTERNAL TONER ADDITIVES

(75) Inventors: Mary L. McStravick, Fairport, NY (US); Mark James Hirsch, Fairport, NY (US); Thomas W. Pike, Rochester, NY (US); Ronald J. Koch, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/046,525

(22) Filed: Jan. 16, 2002

(51) Int. Cl.[7] ..... G03G 9/093
(52) U.S. Cl. ..... 430/108.11; 430/110.2; 430/137.11
(58) Field of Search ..... 430/108.11, 108.1, 430/110.2, 137.11

(56) References Cited

U.S. PATENT DOCUMENTS

| | | | | |
|---|---|---|---|---|
| 1,442,835 | A | | 1/1923 | Surplus |
| 2,871,233 | A | | 1/1959 | Pfitzner et al. |
| 2,891,938 | A | | 6/1959 | Schetty |
| 2,891,939 | A | | 6/1959 | Schetty |
| 2,933,489 | A | | 4/1960 | Biedermann et al. |
| 2,986,521 | A | | 5/1961 | Wielicki |
| 3,590,000 | A | | 6/1971 | Palermiti et al. |
| 3,893,935 | A | | 7/1975 | Jadwin et al. |
| 3,900,588 | A | | 8/1975 | Fisher |
| 3,944,493 | A | | 3/1976 | Jadwin et al. |
| 4,007,293 | A | | 2/1977 | Mincer et al. |
| 4,053,462 | A | | 10/1977 | Beffa et al. |
| 4,079,014 | A | | 3/1978 | Burness et al. |
| 4,206,064 | A | | 6/1980 | Kiuchi et al. |
| 4,221,856 | A | | 9/1980 | Lu |
| 4,265,990 | A | | 5/1981 | Stolka et al. |
| 4,291,111 | A | | 9/1981 | Lu |
| 4,298,672 | A | | 11/1981 | Lu |
| 4,312,933 | A | | 1/1982 | Lu |
| 4,314,937 | A | | 2/1982 | Beffa |
| 4,338,390 | A | | 7/1982 | Lu |
| 4,394,430 | A | | 7/1983 | Jadwin et al. |
| 4,404,271 | A | | 9/1983 | Kawagishi et al. |
| 4,411,974 | A | | 10/1983 | Lu et al. |
| 4,433,040 | A | | 2/1984 | Niimura et al. |
| 4,558,108 | A | | 12/1985 | Alexandru et al. |
| 4,560,635 | A | | 12/1985 | Hoffend et al. |
| 4,563,408 | A | | 1/1986 | Lin et al. |
| 4,584,253 | A | | 4/1986 | Lin et al. |
| 4,585,884 | A | | 4/1986 | Lin et al. |
| 4,883,736 | A | | 11/1989 | Hoffend et al. |
| 4,904,762 | A | | 2/1990 | Chang et al. |
| 4,935,326 | A | | 6/1990 | Creatura et al. |
| 4,937,166 | A | | 6/1990 | Creatura et al. |
| 5,223,368 | A | | 6/1993 | Ciccarelli et al. |
| 5,304,449 | A | | 4/1994 | Hollenbaugh, Jr. |
| 5,352,556 | A | | 10/1994 | Mahabadi et al. |
| 5,698,422 | A | * | 12/1997 | Sacripante et al. ..... 430/109 |
| 6,004,712 | A | | 12/1999 | Barbetta et al. |
| 6,004,714 | A | | 12/1999 | Ciccarelli et al. |
| 6,010,812 | A | | 1/2000 | Barbetta et al. |
| 6,017,668 | A | | 1/2000 | Young et al. |
| 6,042,981 | A | | 3/2000 | Barbetta et al. |
| 6,051,353 | A | | 4/2000 | Hoffend et al. |
| 6,071,665 | A | | 6/2000 | Dickerson et al. |
| 6,083,652 | A | | 7/2000 | Duggan et al. |
| 6,087,059 | A | | 7/2000 | Duggan et al. |
| 6,103,440 | A | | 8/2000 | Lohr |
| 6,124,071 | A | | 9/2000 | Lin et al. |
| 6,132,917 | A | | 10/2000 | Hoffend et al. |
| 6,153,346 | A | | 11/2000 | Maehata et al. |
| 6,190,814 | B1 | | 2/2001 | Law et al. |
| 6,214,510 | B1 | | 4/2001 | Kojima et al. |
| 6,251,554 | B1 | | 6/2001 | Hoffend et al. |
| 6,294,302 | B1 | | 9/2001 | Serizawa et al. |
| 6,355,391 | B1 | * | 3/2002 | Van Dusen et al. ..... 430/111.32 |

* cited by examiner

*Primary Examiner*—John Goodrow
(74) *Attorney, Agent, or Firm*—Oliff & Berridge, PLC; Eugene O. Palazzo

(57) ABSTRACT

A toner composition includes toner particles formed of a resin and a colorant; and one or more external additives, at least one of the external additives including polymeric particles, applied to a surface of the toner particles. The polymeric particles include a polymer selected from polymethylmethacrylate, modified polymethylmethacrylate, halogenated polymethylmethacrylates, and mixtures thereof.

25 Claims, No Drawings

POLYMERIC PARTICLES AS EXTERNAL TONER ADDITIVES

BACKGROUND OF THE INVENTION

1. Field of Invention

This invention relates to toner additive compositions and more specifically, to toners with surface additives, such as polymers, like polymethylmethacrylates, halogenated, such as fluorinated, polymethylmethacrylates, and the like and which toners, prepared for example, by conventional grind processes or emulsion/aggregation processes, use these additives as a transfer and/or blade cleaning aid and these additives improve the transfer efficiency and/or blade cleanability of the developed toners. Yet more specifically the toner surface additives permit the lessening of photoreceptor scratching initiated in the cleaning blade nip present in an imaging or printing apparatus. With further regard to the surface additives, the size thereof and average molecular weight thereof can be selected to minimize the prior art disadvantages of, for example, abrasive toner and additive crush on the blade, which causes photoreceptor scratching, while maintaining the prior art advantage of improved transfer efficiency.

2. Description of Related Art

In electrophotography, a photoreceptor containing a photoconductive insulating layer on a conductive layer is imaged by first uniformly electrostatically charging its surface. The photoreceptor is then exposed to a pattern of activating electromagnetic radiation, such as light or a laser source. In charged area development (CAD) processes, the radiation selectively dissipates the charge in the illuminated areas of the photoconductive insulating layer while leaving behind an electrostatic latent image in the non-illuminated areas. This electrostatic latent image may then be developed to form a visible image by depositing finely divided toner particles on the surface of the photoconductive insulating layer. In discharged area development (DAD) processes, the radiation selectively dissipates the charge in the illuminated areas of the photoconductive insulating layer to form an electrostatic latent image. This discharged electrostatic latent image may then be developed to form a visible image by depositing finely divided toner particles on the surface of the photoconductive insulating layer. In either process, the resulting visible image may then be transferred from the photoconductor to a support, such as transparency or paper. Alternatively, in the case of tandem development systems, the resulting visible image may then be transferred from the photoconductor to an intermediate transfer belt where the image is built up and then transferred to a support, such as transparency or paper. This imaging process may be repeated many times.

Various toner compositions for such a printing system are well known in the art, and have been produced having a wide range of internal and external additives and constituent materials. Generally, however, the toner particles include a binding material such as a resin, a colorant such as a dye and/or a pigment, and any of various internal and external additives to provide particular properties to the toner particles.

One type of external additive that is commonly used in toner compositions is a surface additive. The surface additive can be incorporated for any of various reasons, including for providing improved charging characteristics, improved flow properties, and the like.

For example, toner compositions with certain surface additives, including certain silicas, are known. Examples of these additives include fumed silicas, such as certain AEROSILS like R972™ available from Degussa, metal salts and metal salts of fatty acids inclusive of zinc stearate, calcium stearate, aluminum oxides, cerium oxides, other metal oxides, and mixtures thereof. Generally, such additives are each present in an amount of from about 0.1 percent by weight to about 5 percent by weight, and preferably in an amount of from about 1 percent by weight to about 3 percent by weight, of the toner composition. Several of the aforementioned additives are illustrated, for example, in U.S. Pat. Nos. 3,590,000 and 3,900,588, the entire disclosures of which are incorporated herein by reference.

For example, U.S. Pat. No. 6,214,510 discloses external toner additives, which function as transfer aids. The external additives are inorganic oxides, such as silica or titania, having a volume average particle diameter of from 0.05 to 0.5 micron.

In a like manner, U.S. Pat. Nos. 6,294,302 and 6,153,346 disclose the use of various organic and inorganic fine powders in toner production. The inorganic fine powders can include silica, titania, calcium carbonate, magnesium carbonate, tricalcium phosphate and cerium oxide, and the organic fine powders can include vinyl series resin, a polyester resin and a silicone resin. The powders are useful as external additives, such as for cleaning aids.

Also known are toners containing a mixture of hexamethyldisilazane (HMDZ) and aminopropyltriethoxysilane (APTES) treated silicas. Disadvantages associated with these toners may include, in certain instances, a low, relatively unstable triboelectric charge, and high relative humidity sensitivity. Further, disadvantages of toners containing surface additives treated with HMDZ include, for example, unstable triboelectric charge, relative humidity sensitivity, and low charge/wrong sign toner as measured by a charge spectrograph.

Developer compositions with charge enhancing additives, which impart a positive or negative charge to the toner resin, are also known. For example, U.S. Pat. No. 3,893,935 describes the use of quaternary ammonium salts as internal charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide. Similar teachings are presented in U.S. Pat. Nos. 4,312,933 and 4,291,111. There is also described in U.S. Pat. No. 2,986,521 developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also there is disclosed in U.S. Pat. No. 4,338,390, the entire disclosure of which is incorporated herein by reference, developer compositions containing as charge enhancing additives organic sulfate and sulfonates, which additives can impart a positive charge to the toner composition. Further, there is disclosed in U.S. Pat. No. 4,298,672, the entire disclosure of which is incorporated herein by reference, positively charged toner compositions with resin particles and pigment particles, and as charge enhancing additives alkyl pyridinium compounds. Additionally, other patents disclosing positively charged toner compositions with charge control additives include, for example, U.S. Pat. Nos. 3,944,493; 4,007,293; 4,079,014; 4,394,430 and 4,560,635, which illustrate a toner with a distearyl dimethyl ammonium methyl sulfate charge additive. Surface additives, such as silicas like AEROSILS, may be incorporated into the toners of these patents.

Moreover, toner compositions with negative charge enhancing additives are known, as described, for example, in U.S. Pat. Nos. 4,411,974 and 4,206,064, the entire disclosures of which are incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

U.S. Pat. No. 4,404,271 describes a toner that contains a metal complex where the metal can be chromium, cobalt or iron. Additionally, other patents disclosing various metal containing azo dyestuff structures wherein the metal is chromium or cobalt include U.S. Pat. Nos. 2,891,939, 2,871,233, 2,891,938, 2,933,489, 4,053,462 and 4,314,937. Also, in U.S. Pat. No. 4,433,040, the entire disclosure of which is incorporated herein by reference, there are illustrated toner compositions with chromium and cobalt complexes of azo dyes as negative charge enhancing additives. Other charge enhancing additives include those illustrated in U.S. Pat. Nos. 5,304,449, 4,904,762, and 5,223,368, the entire disclosures of which are incorporated herein by reference.

Despite the broad range of additives that have been used in formulating toner compositions, there is a continued need in the art for improved toner compositions that provide improved results and improved image quality.

For example, U.S. Pat. No. 6,124,071 discloses toner compositions including a polymer and titanium oxide dihydroxide of the formula —O—$Ti(OH)_2$. The titanium oxide dihydroxide is a charge additive. U.S. Pat. No. 6,087,059 describes a toner comprised of resin, colorant and a surface additive mixture comprised of two coated silicas, and a coated metal oxide. U.S. Pat. No. 6,017,668 discloses a toner composition comprising resin, colorant, and a surface additive mixture of a magnetite and a polyvinylidene fluoride. U.S. Pat. No. 6,004,714 discloses a toner comprised of binder, colorant, and a silica containing a coating of an alkylsilane, including polyalkylsilanes such as decylsilane. Each of the toner compositions are disclosed as providing a number of advantages, such as excellent triboelectric charging characteristics, substantial insensitivity to humidity, superior toner flow through, stable triboelectric charging values, and wherein the toners enable the generation of developed images with superior resolution, and excellent color intensity.

SUMMARY OF THE INVENTION

Despite these and other various toner composition formulations, there remains a need in the art for improved toner compositions. For example, although various of the above-described surface additives have provided improved printing and processing characteristics, including transfer efficiency, some of the additives possess certain drawbacks that preferably should be overcome to provide still further improved performance results.

For example, although silica-based additives, such as sol-gel silicas, provide desired transfer efficiency, it has been discovered that the silicas also lead to increased photoreceptor scratching and faster wear rates. That is, it has been discovered that the silica particles may lead to initiation and exacerbation of scratches on the photoreceptor surface. It has also been discovered that the photoreceptor is uniformly worn away at a faster rate if silicas are present. It has been observed that toner and additive crush occurs at some areas of the photoreceptor cleaning blade, but not at other areas of the cleaning blade. In the areas of the cleaning blade where toner and additive crush has been observed, it is also observed that increased photoreceptor scratching is present. The need thus remains for toner surface additives that provide the desired positive toner performance characteristics, but which also provide decreased photoreceptor scratching and wear and thus increased photoreceptor lifetime.

The present invention addresses these problems by using, as a toner particle surface additive, polymeric particles of, for example, polymethylmethacrylates or halogenated (such as fluorinated) polymethylmethacrylates. Use of such polymeric particles as external toner additives provides significant benefits to the toner compositions. Unlike prior external additives, the polymeric particles of the present invention do not cause increased photoreceptor scratching, and do not lead to heightened toner and additive crush on the cleaning blade. Yet, at the same time, the polymeric particles provide acceptable transfer efficiency.

In particular, the present invention provides a toner composition comprising:

toner particles comprising a resin and a colorant; and one or more external additives, at least one of said external additives comprising polymeric particles, applied to a surface of said toner particles, said polymeric particles comprising a polymer selected from the group consisting of polymethylmethacrylate, modified polymethylmethacrylate, halogenated polymethylmethacrylates, and mixtures thereof.

The present invention also provides a developer containing such a toner.

Furthermore, the present invention provides a process for preparing a toner composition, comprising:

providing toner particles comprising a resin and a colorant; and applying to said toner particles polymeric particles as an external additive, said polymeric particles comprising a polymer selected from the group consisting of polymethylmethacrylate, modified polymethylmethacrylate, halogenated polymethylmethacrylates, and mixtures thereof.

The present invention also provides developer compositions including such a toner composition, and methods for making and using such a toner composition.

DETAILED DESCRIPTION OF PREFERRED EMBODIMENTS

According to the present invention, a toner is provided that includes at least a binder, a colorant, and one or more surface additives. The surface additives can include, for example, fumed silica particles for flow properties, metal oxide particles for triboelectric stability, and polymeric materials in the form of particles. The polymeric particles can, if desired, be further treated to improve their properties.

As the base material for the surface additive, any suitable polymeric material can be used. Preferably, however, the polymeric material is a polymethyl methacrylate, a derivative thereof, a halogenated polymethyl methacrylate, a derivative thereof, a mixture thereof, or the like. Other polymeric materials, particularly those having similar mechanical strength to the aforementioned polymethyl methacrylates, can also be used. Copolymers of these materials with other monomers can also be used, as can mixtures of copolymers and homopolymers. An example of a commercially available polymethylmethacrylate suitable for use in the present invention is MP1451, available from Soken Chemical.

Modified forms of the above polymeric materials can also be used. For example, in embodiments of the present invention, sodium lauryl sulfate modified materials, such as sodium lauryl sulfate-polymethyl methacrylate. Sodium lauryl sulfate modified polymers are disclosed, for example, in U.S. Pat. Nos. 6,251,554 and 6,132,917, the entire disclosures of which are incorporated herein by reference.

Other suitable polymeric materials include the various polymeric materials that have found use in coating compositions for toner and developer carriers. Such materials are disclosed, for example, in U.S. Pat. Nos. 6,251,554, 6,132,917, 6,083,652, 6,051,353, 6,042,981, 6,010,812, and 6,004,712, the entire disclosures of which are incorporated herein by reference.

If desired, the polymeric material can be a halogenated polymeric material, where the halogen is preferably fluorine, but can alternatively or additionally be selected from any of the other halogens, such as chlorine. Examples of such polymeric materials thus include, for example, halogenated polymethyl methacrylate and halogenated modified polymethyl methacrylate such as halogenated sodium lauryl sulfate polymethyl methacrylate. When halogenated polymeric materials are used, the halogenation can be directly to the homopolymer itself (or its precursor monomers), or can be incorporated into the polymeric material in the form of a comonomer. Thus, for example, the halogenation can be introduced in the form of a halogenated (substituted) acrylate or methacrylate monomer, although it will be apparent that monomers other than acrylates and methacrylates can be used. Suitable comonomers include, but are not limited to, trifluoroethylacrylate, trifluoroethylmethacrylate, pentafluorophenylacrylate, pentafluorophenylmethacrylate, hexafluoroisopropylacrylate, hexafluoroisopropylmethacrylate, tetrafluoropropylacrylate, tetrafluoropropylmethacrylate, perfluorooctylacrylate, perfluorooctylmethacrylate, dodecafluoroheptylacrylate, dodecafluoroheptylmethacrylate, hexafluorobutylacrylate, hexafluorobutylmethacrylate, heptadecafluorodecylacrylate, heptadecafluorodecylmethacrylate, mixtures thereof, and the like. Thus, for example, trifluoroethylmethacrylate can be reacted with methyl methacrylate to form a copolymer of poly(methylmethacrylate-co-trifluoroethylmethacrylate).

When halogenated polymeric materials are used, it is preferred in embodiments that the degree of halogenation be in the range of about 10 or about 15 to about 55 or about 65%. That is, from about 10 or about 15 to about 55 or about 65% of the available halogenation sites are halogenated. Preferably, the degree of halogenation is from about 20 or about 25 to about 50 or about 55%, such as about 35% or about 40%.

If desired, the polymeric materials may include a mixture of the above polymers. Thus, for example, the polymeric material can be 100% non-halogenated material or 100% halogenated material, or a combination thereof at any suitable level of from just above 0% non-halogenated material to just below 100% non-halogenated material.

Preferably, according to embodiments of the present invention, the polymeric material used to form the polymeric particles has a relatively high weight average molecular weight of from about 300,000 to about 1,400,000. Preferably, in embodiments, the polymeric material forming the polymeric particles has a weight average molecular weight of from about 400,000 or about 500,000 to about 1,300,000 or about 1,400,000. Of course, molecular weights outside of these ranges can be used, as desired. Moreover, it will be understood that desirable molecular weight ranges can vary depending on the material being used. Thus, for example, where a polymethylmethacrylate is being used that is unsubstituted (i.e., non-halogenated), it is preferred in embodiments that the weight average molecular weight be from about 300,000 to about 700,000 or from about 370,000 to about 620,000; when a substituted (i.e., halogenated) material is used, it is preferred in embodiments that the weight average molecular weight be from about 900,000 to about 1,400,000. Of course, as above, molecular weights outside of these ranges can be used, as desired.

An important characteristic of the polymeric materials forming the polymeric particles is the glass transition temperature. Because the polymeric particles adhere to toner particles, it is important that the polymeric particles exhibit desirable toner development characteristics. Thus, for example, it is preferred that the polymeric particles have a glass transition temperature of from about 80 to about 150° C., preferably from about 90 to about 130° C., and even more preferably from about 100 to about 120° C. However, materials with different glass transition temperatures can be used, as required.

Another important characteristic of the polymeric materials forming the polymeric particles is the size of the particles. Size of the particles is important because the particles must be sufficiently large to provide their desired performance characteristics, but not so large as to become ineffective and detrimental. For example, as the size of the particles increases, it becomes more difficult for the particles to adhere to the toner particle itself. Thus, in embodiments of the present invention, it is preferred that the polymeric particles have an average particle size (or diameter), as measured by the Coulter N4 Plus, of from about 75 to about 200 nm. More preferably, the average particle size is from about 80 or about 90 to about 150 or about 200 nm, even more preferably from about 100 to about 140 or from about 100 to about 120 nm.

The polymeric particles used in embodiments of the present invention are preferably spherical or substantially spherical in shape. Likewise, in preferred embodiments, the toner particles upon which the polymeric particles are blended can range in shape factor of from about 100 to about 150, where 100 is perfectly spherical, and about 134 corresponds to "potato-shaped" particles.

Once the polymeric particles are formed, they can be blended with the toner particles to form an external surface additive to the toner particles. As necessary or desired, the polymeric particles can be directly blended with the toner particles, or the polymeric particles can first be treated with a flow aid to improve their processability and subsequent adhesion to the toner particles.

If a flow aid is necessary or desired, any conventional or after-developed flow aid can be used, as will be apparent to one of ordinary skill in the art. Suitable flow aids include, for example, but are not limited to, fumed silicas. One class of fumed silicas useful in the present invention are hydrophobic fumed silicas (also known as aerosils). Suitable fumed silicas include those marketed by Degussa, Inc., under the tradename AEROSIL, and by Cabot Corporation under the tradename CABOSIL, although other hydrophobic and hydrophilic silicas can also be used. However, in embodiments, hydrophobic silicas are preferred in view of their relative humidity insensitivity and triboelectric charging properties.

According to the present invention, any suitable silica can be used in forming the hydrophobic silica. Suitable examples include, for example, Aerosil R104™, Aerosil R972™ or Aerosil R812s ™, available from Degussa, Inc., as well as the CABOSIL™ products available from Cabot Corporation. Other examples of suitable silicas that can be used in the present invention include, but are not limited to, those commercially available under the following trade names: AEROSIL R972, R974, R202, R805, R812, RX200, RY200, R809, RX50, RA200HS, and RA20H (available from Nippon Aerosil Co., Ltd.); WACKER HDK H2000, H2050EP, HDK H3050EP, and HVK2150 (available from Wacker Chemicals East Asia Co., Ltd.); Nipsil SS-10, SS015, SS-20, SS-50, SS-60, SS-100, SS-50B, SS-50F, SS-10F, SS-40, SS-70, SS-72F (available from Nippon Silica Industry Co., Ltd.); and CARBOSIL TG820F and TS530 (available from Cabot Specialty Chemicals, Inc.). Other suitable silica flow additives are described, for example, in U.S. Pat. No. 6,190,814, the entire disclosure of which is incorporated herein by reference.

Preferably, in embodiments of the present invention, the hydrophobic silica has an average particle diameter of from about 1 to about 60 nanometers, preferably from about 7 to about 40 nanometers.

When such a flow additive is applied to the polymeric particles, it can be applied in any desired or necessary amount to achieve the desired results. Thus, for example, the polymeric particles and flow aid can be blended in amounts of from about 20:1 or greater (parts by weight polymeric particles to parts by weight flow aid) to about 1:5 or less. Preferably, the polymeric particles are mixed together in amounts of from about 10:1 to about 1:1, such as about 5:1, about 4:1, about 3:1 or about 2:1. Of course, one of ordinary skill in the art will be able to adjust these ratios to obtain the desired results.

The thus formed polymeric particles, which are optionally treated with a flow aid such as fumed silica, can be added to the toner composition in any suitable amount to obtain the desired results. In embodiments, the polymeric particles are present on the surface of the toner particles in an amount of from about 0.1 to about 10 percent by weight, based on the weight of the toner particles. Preferably, the polymeric particles are present in an amount of from about 0.2 or about 0.5 to about 4 or about 5 percent by weight, based on the weight of the toner particles. However, values outside these ranges can be used, in embodiments.

The toner compositions of the present invention, in addition to including the above-described surface additive, generally also include at least a toner resin and a colorant. The toner compositions also generally include other additives, such as a smaller fumed silica (of about 7 to 40 nm) as a flow additive, and a metal oxide (of about 7 to 40 nm) for triboelectric stability and relative humidity sensitivity. In addition, the toner compositions can include one or more conventional additives, including but not limited to, optional charge enhancing additives and optional waxes, especially low molecular weight waxes with an Mw of, for example, from about 1,000 to about 20,000. Suitable toner compositions, which can be modified to include the polymeric particle surface additive of the present invention, include those toner compositions disclosed in, for example, U.S. Pat. Nos. 6,004,714, 6,017,668, 6,071,665, 6,087,059, 6,103,440, and 6,124,071, the entire disclosures of which are incorporated herein by reference. The toner compositions can generally be prepared by any known technique, such as by admixing and heating resin particles, colorant, and optional additives other than the above-described surface additive in a suitable toner extrusion device, such as the ZSK53 available from Werner Pfleiderer, following by removing the formed toner composition from the device. Subsequent to cooling, the toner composition is subjected to grinding utilizing, for example, a Sturtevant micronizer for the purpose of achieving toner particles with a desired volume median diameter of, for example, less than about 25 microns, and preferably of from about 5 to about 12 microns, which diameters are determined by a Coulter Counter. Subsequently, the toner compositions can be classified utilizing, for example, a Donaldson Model B classifier for the purpose of removing fines, that is toner particles having a volume median diameter of less than about 4 microns. Thereafter, the polymeric particles and other optional surface additives can be added to the toner composition by blending the additives with the obtained toner particles.

Although the above description of the toner composition is of a conventional toner, the polymeric particles of the present invention can be applied to a wide range of toners. Suitable toners include, for example, those made by emulsion/aggregation processes and those made from other chemical processes, as well as those made by conventional grinding processes.

As the toner (or binder) resin, any of the conventional toner resins can be used. Illustrative examples of such suitable toner resins include, for example, thermoplastic resins such as vinyl resins in general or styrene resins in particular, and polyesters. Examples of suitable thermoplastic resins include, but are not limited to, styrene methacrylate; polyolefins; styrene acrylates, such as PSB-2700 obtained from Hercules-Sanyo Inc.; polyesters; styrene butadienes; crosslinked styrene polymers; epoxies; polyurethanes; vinyl resins, including homopolymers or copolymers of two or more vinyl monomers; and polymeric esterification products of a dicarboxylic acid and a diol comprising a diphenol. Other suitable vinyl monomers include, but are not limited to, styrene; p-chlorostyrene; unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, and acrylamide; mixtures thereof; and the like. In addition, crosslinked resins, including polymers, copolymers, and homopolymers of styrene polymers, may be selected.

For example, as one toner resin, there can be selected the esterification products of a dicarboxylic acid and a diol comprising a diphenol. These resins are illustrated, for example, in U.S. Pat. No. 3,590,000, the entire disclosure of which is incorporated herein by reference. Other specific toner resins include, but are not limited to, styrene/methacrylate copolymers, and styrene/butadiene copolymers; Pliolites; suspension polymerized styrene butadienes, reference U.S. Pat. No. 4,558,108, the entire disclosure of which is incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol; reactive extruded resins, especially reactive extruded polyesters with crosslinking as illustrated in U.S. Pat. No. 5,352,556, the entire disclosure of which is incorporated herein by reference, styrene acrylates, and mixtures thereof. Also, waxes with a molecular weight Mw of from about 1,000 to about 20,000, such as polyethylene, polypropylene, and paraffin waxes, can be included in, or on the toner compositions as fuser roll release agents.

The toner resin is generally present in any sufficient, but effective amount. For example, the toner resin is generally present in an amount of from about 50 to about 95 percent by weight of the toner composition. More preferably, the toner resin is generally present in an amount of from about 70 to about 90 percent by weight of the toner composition.

The toner composition also generally includes a colorant. As desired, the colorant can be a dye, a pigment, a mixture of a dye and a pigment, or two or more of them. As colored pigments, there can be selected, for example, various known cyan, magenta, yellow, red, green, brown, or blue colorants, or mixtures thereof. Specific examples of pigments include, but are not limited to, phthalocyanine HELIOGEN BLUE L6900™, D6840™, D7080™, D7020™, PYLAM OIL BLUE™, PYLAM OIL YELLOW™, PIGMENT BLUE 1™, available from Paul Uhlich & Company, Inc., PIGMENT VIOLET 1™, PIGMENT RED 48™, LEMON CHROME YELLOW DCC 1026™, E.D. TOLUIDINE RED™and BON RED C™available from Dominion Color Corporation, Ltd., Toronto, Ontario, NOVAPERM YELLOW FGL™, HOSTAPERM PINK E™from Hoechst, CINQUASIA MAGENTATA™available from E. I. DuPont de Nemours & Company, Pigment Yellow 180, Pigment Yellow 12, Pigment Yellow 13, Pigment Yellow 14, Pigment Yellow 17, Pigment Blue 15, Pigment Blue 15:3, Pigment Red 122, Pigment Red 57:1, Pigment Red 81:1, Pigment Red 81:2, Pigment Red 81:3, and the like.

Generally, colored dyes and pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Other soluble dyes, such as red, blue, green, and the like, can also be used, as desired.

Generally, the colorant is included in the toner composition in known amounts, for the desired color strength. For example, the above-described dyes and pigments, and others, can be included in the toner composition in any suitable amount, such as from about 1 to about 20 percent by weight of the toner composition. Preferably, the colorant is included in an amount of from about 2 to about 10 percent by weight of the toner composition.

If desired, such as to give the toner composition magnetic properties, magnetites can also be included in the toner composition, either for their magnetic properties, or for the colorant properties, or both. Suitable magnetites that can be used in the toner compositions of the present invention include, but are not limited to, a mixture of iron oxides (FeO, $Fe_2O_3$), including those commercially available as MAPICO BLACK™. The magnetite can be present in the toner composition in any of various effective amounts, such as an amount of from about 10 percent by weight to about 75 percent by weight of the toner composition. Preferably, the magnetite is present in an amount of from about 30 percent to about 55 percent by weight of the toner composition.

There can be included in the toner compositions of the present invention charge additives as indicated herein in various effective amounts, such as from about 1 to about 15, and preferably from about 1 to about 3, percent by weight of the toner composition. Such suitable charge additives can include charge additives well known in the art.

Furthermore, the toner compositions of the present invention can also include suitable waxes for their known effect. Suitable waxes include, but are not limited to, polypropylenes and polyethylenes commercially available from Allied Chemical and Petrolite Corporation; Epolene N-15 commercially available from Eastman Chemical Products, Inc.; Viscol 550-P, a low weight average molecular weight polypropylene available from Sanyo Kasei K. K.; mixtures thereof, and the like. The commercially available polyethylenes selected possess, for example, a weight average molecular weight of from about 1,000 to about 1,500, while the commercially available polypropylenes utilized are believed to have a weight average molecular weight of from about 4,000 to about 7,000. Many of the polyethylene and polypropylene compositions useful in the present invention are illustrated in British Pat. No. 1,442,835, the entire disclosure of which is incorporated herein by reference.

The wax can be present in the toner composition of the present invention in various amounts. However, generally these waxes are present in the toner composition in an amount of from about 1 percent by weight to about 15 percent by weight, and preferably in an amount of from about 2 percent by weight to about 10 percent by weight, based on the weight of the toner composition.

The toners of the present invention may also, in embodiments, contain polymeric alcohols, such as UNILINS™, reference U.S. Pat. No. 4,883,736, the entire disclosure of which is incorporated herein by reference. The UNILINS™ products are available from Petrolite Corporation.

According to embodiments of the present invention, the toner is not particularly limited, and the above description is exemplary only. Thus, for example, the polymeric particles of the present invention can be applied to a wide range of toners, including those made by emulsion/aggregation processes as well as those made by conventional grinding processes. Similarly, the polymeric particles of the present invention can be applied to a wide range of shaped toners, ranging from spherical toners (such as those having a shape factor of from 100 to about 120), those having a potato shape (such as those having a shape factor of from about 120 to about 140, or about 134), and the like.

Developer compositions can be prepared by mixing the toners with known carrier particles, including but not limited to coated carriers, such as steel, ferrites, and the like, reference U.S. Pat. Nos. 4,937,166 and 4,935,326, the entire disclosures of which are incorporated herein by reference.

The toner composition and carrier particles are generally mixed to include from about 2 percent toner concentration to about 12 percent toner concentration. The carriers can include coatings thereon, such as those illustrated in the above-referenced U.S. Pat. Nos. 4,937,166 and 4,935,326 patents, and other known coatings. There can be selected a single coating polymer, or a mixture of polymers. Additionally, the polymer coating or coatings may contain conductive components therein, such as carbon black in an amount for example, of from about 10 to about 70 weight percent, and preferably from about 20 to about 50 weight percent. Specific examples of coatings are fluorocarbon polymers, acrylate polymers, methacrylate polymers, silicone polymers, and the like.

Imaging methods are also envisioned with the toners of the present invention. Suitable imaging methods that utilize toner particles are known in the art and include, for example, but are not limited to, the various patents mentioned herein as well as U.S. Pat. Nos. 4,585,884, 4,584,253, 4,563,408, and 4,265,990, the entire disclosures of which are incorporated herein by reference.

By using the polymeric particles of the present invention in toner and developer compositions, the compositions can provide reduced scratch and wear rates to imaging member and photoreceptor surfaces. As described above, it has been discovered that the conventionally used sol gel silica transfer and cleaning aids lead to increased photoreceptor scratching and wear. It has been observed that toner and additive crush occurs at some areas of the photoreceptor cleaning blade, but not at other areas of the cleaning blade. This toner and additive crush and the presence of the sol gel silica leads to initiation and exacerbation of scratches on the photoreceptor surface, as well as faster wear rates. For example, toners with sol gel silicas as the transfer aid have been observed to provide a scratch rating after 70,000 prints of about 3.0 (on a visual rating scale of 1 to 5, with 5 being the worst, and a level 4 producing a barely discernable defect on the print).

In contrast, the polymeric particles of the present invention have been found to reduce the photoreceptor scratch and wear problems. Under similar conditions to the sol-gel silica transfer aids, toners with the polymeric particle transfer aid have been observed to provide a scratch rating after 70,000 prints of only about 1.25 (on the same scale of 1 to 5, with 5 being the worst). The polymeric particles also reduce the overall wear rate to about 8 nm/kcycle, compared to a typical value of 25 nm/kcycle with sol-gel silica additives.

The following examples illustrate specific embodiments of the present invention. One skilled in the art will recognize that the appropriate reagents, and component ratios/concentrations may be adjusted as necessary to achieve specific product characteristics. All parts and percentages are by weight unless otherwise indicated.

EXAMPLES

Example 1

A cyan toner composition is formed using a conventional cyan base toner material obtained from an emulsion/aggregation toner production process. The toner particles have a shape factor of 118. To the toner particles are added the following additives as external additives (percent based on weight of the toner particles):

| Material | Content (%) |
|---|---|
| RY50 (40 nm treated fumed silica) | 1.14 |
| JMT2000 (40 nm treated titanium oxide) | 0.73 |
| Polymeric particles | 1.48 |
| Latex particles (size 1–5 micron; shape factor 134) | 0.5 |
| Blade lubricant | 0.5 |

The polymeric particles are polymethylmethacrylate polymeric particles of the present invention. The materials are blended to form the resultant toner composition.

The toner composition is tested on a xerographic test apparatus, where multiple prints are made using the toner composition. After 70,000 prints are made, a visual inspection is made of the photoreceptor and any observed scratching is assessed using a visual rating scale of 1 to 5, with 5 being the worst, and a level 4 producing a barely discernable defect on the print. Testing shows that the toner composition has a scratch rating of 1.25. The photoreceptor is also measured, and is found to have an overall wear rate of 8 nm/kcycle.

Comparative Example 1

A comparative cyan toner composition is formed using the same base toner material, procedures and additives as Example 1, except that the 1.48% polymeric particles are substituted with 1.48% sol-gel silica.

The toner composition is tested on a xerographic test apparatus as in Example 1. Testing shows that the toner composition has a scratch rating of 3 after 70,000 prints. The photoreceptor is also measured, and is found to have an overall wear rate of 25 nm/kcycle.

What is claimed is:

1. A toner composition comprising:

toner particles comprising a resin and a colorant; and one or more external additives, at least one of said external additives comprising polymeric particles, applied to a surface of said toner particles, said polymeric particles comprising a polymer selected from the group consisting of polymethylmethacrylate, modified polymethylmethacrylate, halogenated polymethylmethacrylates, and mixtures thereof, wherein said polymeric particles have an average diameter of from about 75 to about 150 nm.

2. The toner composition of claim 1, wherein the polymeric particles comprise polymethylmethacrylate.

3. The toner composition of claim 1, wherein the polymeric particles comprise halogenated polymethylmethacrylate.

4. The toner composition of claim 1, wherein the polymeric particles comprise polymethylmethacrylate and halogenated polymethylmethacrylate.

5. The toner composition of claim 4, wherein the polymeric particles contain from about 1 to about 99 percent by weight of said polymethylmethacrylate and from 1 to about 99 percent by weight of said halogenated polymethylmethacrylate.

6. The toner composition of claim 4, wherein said halogenated polymethylmethacrylate has a degree of halogenation of from about 15% to about 55%.

7. The toner composition of claim 4, wherein said halogenated polymethylmethacrylate is a fluorinated polymethylmethacrylate.

8. The toner composition of claim 4, wherein said halogenated polymethylmethacrylate is a chlorinated polymethylmethacrylate.

9. The toner composition of claim 1, wherein the polymeric particles comprise sodium lauryl sulfate polymethylmethacrylate.

10. The toner composition of claim 1, wherein said polymeric particles are surface treated with a flow aid.

11. The toner composition of claim 10, wherein said flow aid comprises silica.

12. The toner composition of claim 10, wherein a weight ratio of said polymeric particles to said flow aid is from about 10:1 to about 1:1.

13. The toner composition of claim 1, wherein said polymer has a weight average molecular weight of from about 300,000 to about 1,400,000.

14. The toner composition of claim 1, wherein said polymer has a weight average molecular weight of from about 300,000 to about 700,000 or from about 900,000 to about 1,400,000.

15. The toner composition of claim 1, wherein said polymeric particles have an average diameter of from about 100 to about 140 nm.

16. The toner composition of claim 1, wherein said polymeric particles are spherical and are blended onto toner particles having a shape factor of about 100 to about 140.

17. The toner composition of claim 1, wherein said toner particles have a shape factor of about 100 to about 120.

18. The toner composition of claim 1, wherein said toner particles have a shape factor of about 120 to about 140.

19. The toner composition of claim 1, wherein said colorant is a pigment.

20. The toner composition of claim 1, wherein said colorant is a dye.

21. The toner composition of claim 1, wherein said colorant comprises a pigment and a dye.

22. A developer composition comprising:

the toner composition of claim 1; and a carrier.

23. A process for preparing a toner composition, comprising:

providing toner particles comprising a resin and a colorant; and applying to said toner particles polymeric particles as an external additive, said polymeric particles comprising a polymer selected from the group consisting of polymethylmethacrylate, modified polymethylmethacrylate, halogenated polymethylmethacrylates, and mixtures thereof, wherein said polymeric particles have an average diameter of from about 75 to about 150 nm.

24. The process of claim 23, further comprising:

treating a surface of said polymeric particles with a flow aid prior to applying the polvmeric particles to said toner particles.

25. The process of claim 24, wherein said flow aid comprises silica.

* * * * *